United States Patent [19]

Mörz et al.

[11] Patent Number: 4,533,887

[45] Date of Patent: Aug. 6, 1985

[54] ROTARY WAVEGUIDE COUPLING HAVING ARCUATE SHAPED DEFLECTING ELEMENTS WITH 2-D BLOCKING STRUCTURES

[75] Inventors: Günter Mörz, Ludwigsburg; Werner Speldrich, Backnang, both of Fed. Rep. of Germany

[73] Assignee: ANT Nachrichtentechnik GmbH, Backnang, Fed. Rep. of Germany

[21] Appl. No.: 476,203

[22] Filed: Mar. 17, 1983

[30] Foreign Application Priority Data

Mar. 18, 1982 [DE] Fed. Rep. of Germany ..... 3209906

[51] Int. Cl.[3] ..... H01P 1/06

[52] U.S. Cl. ..... 333/256; 333/257; 333/261; 343/763

[58] Field of Search ..... 333/256, 261, 251, 249, 333/254, 208, 210, 211, 257; 343/763, 762, 758; 285/272

[56] References Cited

U.S. PATENT DOCUMENTS

| | | | |
|---|---|---|---|
| 2,595,186 | 4/1952 | Breetz | 333/256 X |
| 2,671,885 | 3/1954 | Bouix | 333/256 |
| 2,736,867 | 2/1956 | Montgomery | 333/256 X |
| 2,737,633 | 3/1956 | Tomiyasu | 333/256 |
| 2,772,402 | 11/1956 | Tomiyasu | 333/254 X |
| 2,850,706 | 9/1958 | Gabriel | 333/256 |
| 2,945,193 | 7/1960 | Strom | 333/106 |
| 2,973,493 | 2/1961 | Hasseld, Jr. | 333/257 |
| 3,189,855 | 6/1965 | Forrer | 333/256 |
| 3,604,009 | 9/1971 | Behnke | 343/754 |
| 3,852,762 | 12/1974 | Henf et al. | 343/756 |
| 4,117,426 | 9/1978 | Hudspeth et al. | 333/257 |
| 4,233,580 | 11/1980 | Treczka et al. | 333/261 |
| 4,358,746 | 11/1982 | Miller et al. | 343/763 X |

FOREIGN PATENT DOCUMENTS

| | | |
|---|---|---|
| 2134077 | 8/1975 | Fed. Rep. of Germany . |
| 2624428 | 11/1979 | Fed. Rep. of Germany . |
| 1407755 | 6/1965 | France . |
| 2092709 | 1/1972 | France . |
| 747175 | 3/1956 | United Kingdom . |

OTHER PUBLICATIONS

Wood, R. A., "Microwave Rotating Joints", *Electronics*, #70, 13 Mar. 1975, pp. 49–50.

Kiyo Tomiyasu, "A New Annular Waveguide Rotary Joint", Apr. 1956, pp. 548–553.

*Primary Examiner*—Eugene R. LaRoche
*Assistant Examiner*—Benny T. Lee
*Attorney, Agent, or Firm*—Spencer & Frank

[57] ABSTRACT

A rotary waveguide coupling including coupling members which are coaxially rotatable with respect to one another and comprise waveguide sections produced by dividing an annular waveguide in a longitudinal sectional plane. Inputs and outputs of the waveguides to be rotated with respect to one another disposed in the side walls of the waveguide sections.

19 Claims, 12 Drawing Figures

FIG. 1
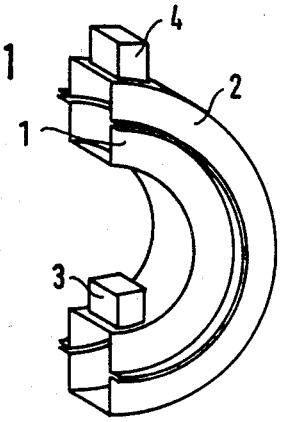
FIG. 2
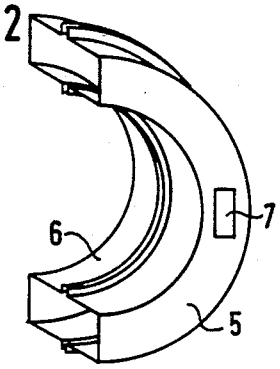
FIG. 4a
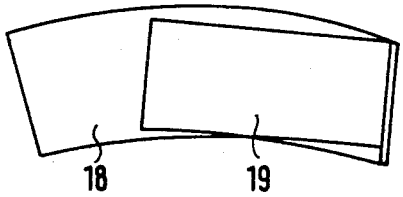
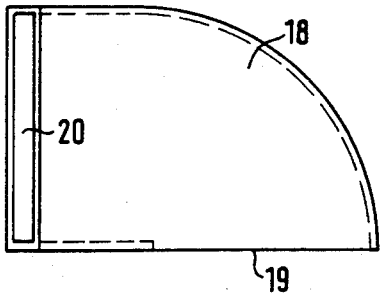
FIG. 4b
FIG. 5
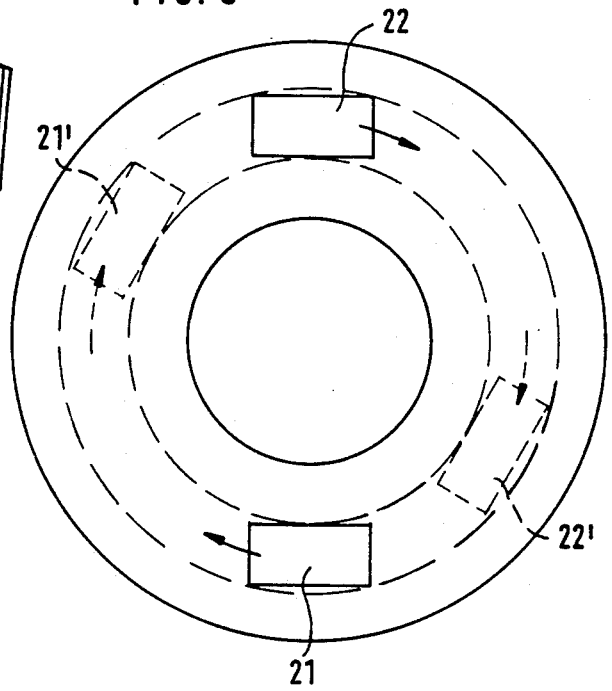

5
13
12
14
17
9
C
D

SECTION C-D
5
7
9
14
12
15
16
17

5
8
10
14
7
9
13
6
11

A
B
17
10
6

SECTION A-B
6
10
16
17
15
8

ROTARY WAVEGUIDE COUPLING HAVING ARCUATE SHAPED DEFLECTING ELEMENTS WITH 2-D BLOCKING STRUCTURES

BACKGROUND OF THE INVENTION

The present invention relates to a rotary waveguide coupling whose axially rotatably connected coupling members have at least one waveguide input or output, respectively.

In known rotary couplings, a rotationally symmetrical field is generated in the plane of rotation because the propagation characteristics of such a field are not influenced by the rotation. For this purpose, coaxial conductors (TEM-Type) or circular waveguides ($TH_{01}$- or $TE_{01}$-Type) are used as coupling members which are rotatable with respect to one another. Such rotary couplings are disclosed, for example, in German Pat. Nos. 2,624,428, issued Nov. 8th, 1979 and 2,134,077, issued Aug. 28th, 1975. In such rotary couplings, particularly if rectangular waveguides are used as the input or output waveguides of the rotary coupling, rather complicated transitions to the rotationally symmetrical coupling members are required. As demonstrated by German Pat. No. 2,134,077, this is primarily the case whenever the rotary coupling is of the multichannel design.

Such transitions and the measures connected therewith for mode conversion, result in an increase in the transmission attenuation of the rotary coupling and produce annoying resonances. Moreover, the rotary couplings operating according to the prior art principle are not very broadbanded, thus placing narrow limits on multichannel designs.

SUMMARY OF THE INVENTION

It is therefore the object of the present invention to provide a rotary waveguide coupling of the above-mentioned type which can be designed to operate as a multichannel waveguide with low mechanical expenditures and which has the high bandwidth required for such operation.

The above object is generally achieved according to the present invention, in that the two coupling members, which are rotatable with respect to one another and each contain an input or an output, are comprised of waveguide sections which are formed by dividing an annular waveguide in a longitudinal sectional plane and which are disposed adjacent one another so as to define the annular waveguide.

The annular waveguide defined by one of the waveguide sections can be bent in the H plane or the E plane of the waveguide cross section.

According to the preferred embodiment of the invention, the first and second waveguide sections do not electrically contact one another and a two dimensional wave blocking structure is provided for supressing interfering waves excited in the separating gap between the first and second waveguide sections.

According to a further feature of the invention wave deflectors are provided at the input and the output of the two waveguide sections so as to impart a defined direction of rotation to waves entering and exiting the rotary waveguide coupling.

According to a further feature of the invention, the rotary coupling may be either a single channel device or a multichannel device by providing multiple inputs and outputs.

According to a further embodiment of the invention, a pair of annular waveguides, each defined by two waveguide sections formed by dividing an annular waveguide along a longitudinal sectional plane, are connected and coupled together to form a rotary coupling, which depending on the orientation of the associated deflection elements, has an electrical length which can be varied or kept constant.

Finally according to a further embodiment of the invention, an annular waveguide defined by two waveguide sections formed by dividing an annular waveguide along a longitudinal sectional plane is connected to and coupled with at least one further annular waveguide to provide a rotary coupling with an unlimited angle of rotation.

BRIEF DESCRIPTION OF THE DRAWINGS

FIG. 1 is a partial perspective view of a rotary coupling according to the invention with the two coaxial coupling members being radially disposed.

FIG. 2 is a partial perspective view of a rotary coupling member according to the invention with the two coaxial coupling members being arranged axially adjacent one another.

FIGS. 4*a* and 4*b* are a plan and side view respectively of an alternate waveguide deflection element.

FIG. 5 is a schematic representation of a two-channel rotary coupling according to the invention.

DETAILED DESCRIPTION OF THE PREFERRED EMBODIMENTS

Figure 3B:
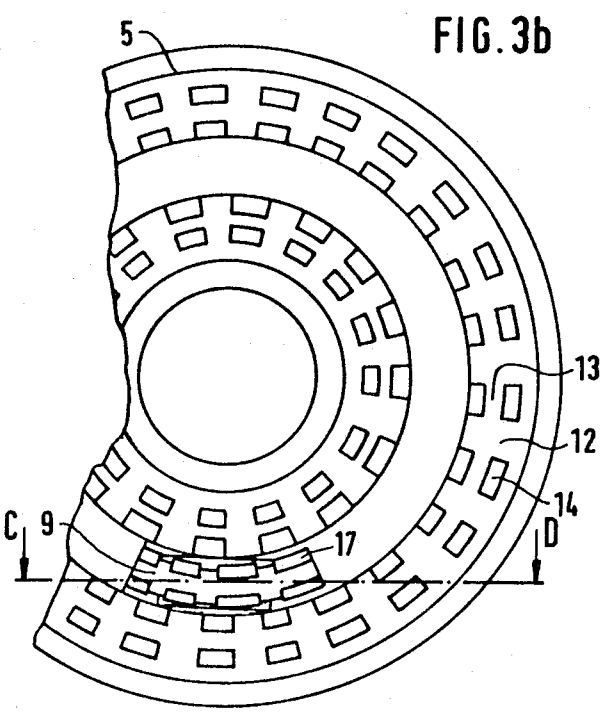
FIGS. 3*b* and 3*c* are plan views of the adjacent surfaces of the two rotary coupling members of the embodiment of FIG. 3*a*.

In the rotary coupling according to the invention, the mutually rotatable coupling members are comprised of an annular waveguide which is divided into sections in a longitudinal sectional plane. FIG. 1 shows a portion of a rectangular waveguide which is bent in the form of a closed ring in the H plane and which is divided into two waveguide sections 1 and 2 along a longitudinal plane, which sections likewise lies in the E plane. The waveguide sections 1 and 2 produced by the division of the waveguide are thus radially disposed and are arranged to be rotatable coaxially to one another. The waveguide input and/or output 3 and 4 for the coupling are disposed in the side walls of the waveguide sections 1 and 2, respectively.

A rectangular waveguide bent in the shape of a closed ring in the E plane and divided into two waveguide sections 5 and 6 by a longitudinal division in the E plane is shown in FIG. 2. In this figure, only the waveguide input 7 is visible in the side wall of waveguide section 5. It is understood however, that a waveguide output is similarly disposed in the side wall of the waveguide section of coupling member 6.

The longitudinal sectional plane (E plane, H plane) in which transverse currents are at a minimum is most appropriately selected as the separating plane for the annular waveguide. Transverse currents appearing in the separating plane would excite interfering waves in the gap between the waveguide sections, 1,2 or 5,6, primarily if these sections are not electrically contacted with one another. Such a contact free coupling, the so-called choke coupling, has a particular significance since it eliminates slip contacts which are prone to malfunction. Therefore, the description that follows is based exclusively on a contactless rotary coupling. Moreover, the embodiments to follow are based on the coupling principle shown in FIG. 2 in which the waveguide sections are bent into a ring in the E plane and are arranged axially behind one another. These embodiments can also be transferred in an equivalent manner to the principle shown in FIG. 1 wherein the waveguide sections are bent in the H plane and are arranged coaxially and radially one above the other.

Figure 3D:
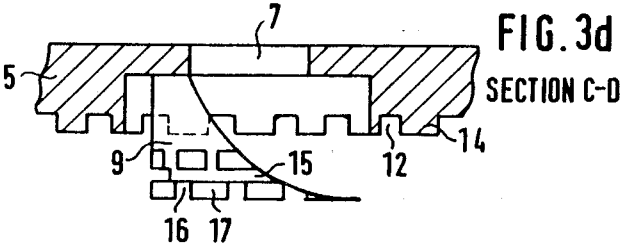
FIGS. 3*d* and 3*e* are sectional views along the lines C-D and A-B of FIGS. 3*b* and 3*c* respectively.
Figure 3A:
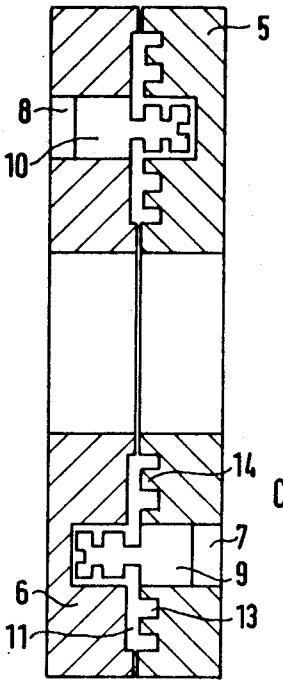
FIG. 3*a* is a cross-sectional view of a single channel rotary coupling according to the invention.
Figure 3C:
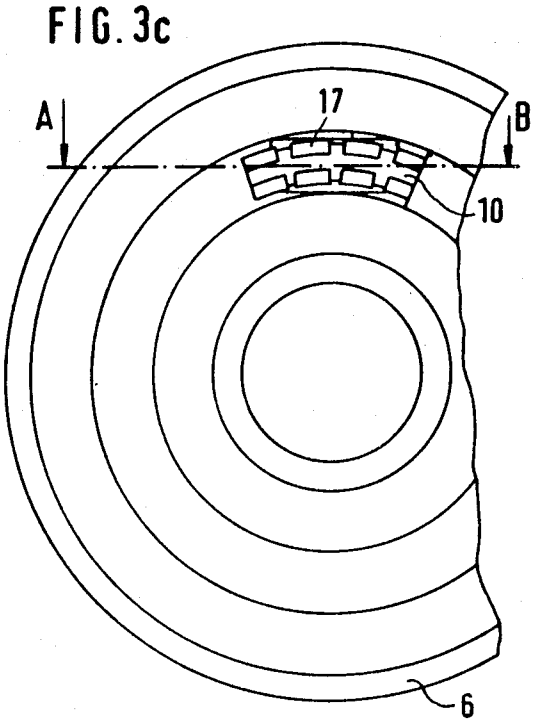

FIG. 3*a* is a cross-sectional view of a two-part rotary coupling. A plan view onto the interior of the two waveguide sections 5 and 6 is shown in FIGS. 3*b* and 3*c* respectively. The inputs and outputs provided in the side walls of the waveguide sections 5 and 6 are marked with the numerals 7 and 8 respectively. A wave fed in, for example, through input 7 is conducted by a deflection element 9, which is fixed in waveguide section 5 in front of input 7, to travel in a specifically defined direction of rotation in the rotary waveguide coupling 5,6. The deflection element 10 fixed in waveguide section 6 in front of output 8 conducts the wave back out of the rotary waveguide coupling.

Figure 3E:
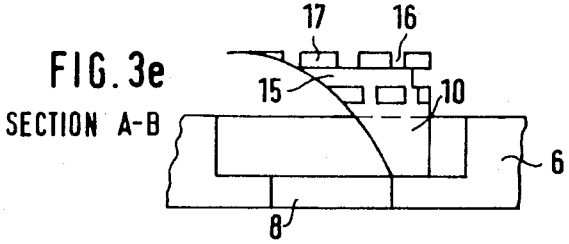

The sectional views A-B and C-D shown through deflection elements 10 and 9 in FIGS. 3*e* and 3*d*, respectively, show their mode of operation.

While each deflection element 9 and 10, as already mentioned, has its bottom region permanently contacted with a waveguide section 5 and 6 respectively, its upper region extends without contact into the respectively opposite waveguide section 6 or 5 respectively, as shown in FIG. 3*a*. As a result of the contact-free guidance interfering waves are inevitably excited in the gaps between the deflection elements 9 and 10 and the waveguide walls.

The interfering waves generated due to the deflection elements 9 and 10 propagate tangentially as well as radially through the separating gap 11 provided between the two waveguide sections 5 and 6 due to the contactless guidance. In order to suppress the interfering waves in the separating gap, a blocking structure, which is effective in both directions, is therefore provided. Only the separating plane of waveguide section 5 has such a blocking structure, as shown in FIG. 3*b* which is a plan view of the dividing plane of waveguide section 5. A blocking structure is provided there which is derived from the known waffle-iron filter (see Microwave Filters, Impedance Matching Networks and Coupling Structures, McGraw Hill, 1964). This special blocking structure with two-dimensional effect is produced in that circularly extending grooves 13 and radially extending grooves 12 are cut into the dividing plane of section 5 so that they extend parallel and perpendicular, respectively, to the curved waveguide axis. The grooves 12 and 13 and the remaining bars 14 have such dimensions that the limit frequency of the blocking structure lies far below the lowest frequency of the transmitted frequency band.

The noncontacted upper region of each of the deflecting elements 9 and 10, which in the embodiments shown in FIGS. 3*a* through 3*e* (particularly FIGS. 3*d* and 3*e*) comprise hook-shaped bent solid molded members, is also provided with a blocking structure derived from the concept of the waffle iron filter. This blocking structure is provided, on the one hand, to reduce the excitation of interfering waves and, on the other hand, to take care that no waves propagate in the direction opposite to the deflection direction. For that purpose, the entire surface of each of the deflection elements 9 and 10 is provided with vertically and horizontally extending grooves 15, 16 and bars 17 to form wave traps.

Under certain circumstances it may be advisable to provide the rear sides of the deflecting elements 9 and 10 with absorber material.

Instead of these solid molded deflection members 9 and 10, thin-walled waveguide pieces which are curved in the E plane and in the H plane can also be used as deflecting elements. FIG. 4*a* shows such a waveguide piece 18 from its underside, where its input 19 is visible, which is placed over input 7 or output 8 in waveguide section 5 or 6, respectively. In this illustration, the curvature of waveguide piece 18 in the E plane is visible. The side view (FIG. 4*b*) shows the curvature in the H plane. This view shows the output 20 of the waveguide piece 18 which is oriented in one of the two circumferential directions of the annular, divided waveguide. This deflecting element 18 also is fastened with its lower region in one of the waveguide sections 5 or 6 and moves with its upper section through the other waveguide section without making contact.

In the above description of the present invention, reference has been made to a single-channel rotary coupling, i.e. a rotary coupling having only one signal input and one signal output. The rotary coupling according to the invention can just as easily be designed as a multichannel system. FIG. 5 is a schematic representation of a two-channel rotary coupling, wherein each waveguide section has two signal inputs 21 and 22 and two signal outputs 21' and 22'. The signal fed into input 21 of the upper waveguide section is fed into the annular waveguide in the direction of the arrow and is brought out of the waveguide section therebelow through output 21' which is shown in dashed lines. Output 22' is associated correspondingly with input 22. The orientation of the deflecting elements, disposed at the inputs 21, 22 and the outputs 21', 22', define the associations between inputs and outputs and assure that the signal channels are not superposed on one another in the annular waveguide. In the illustrated embodiment, the deflection elements of associated inputs and outputs, e.g. 21 and 21', are oriented in mutually opposite directions.

A practical embodiment of the above-described rotary coupling having a center ring diameter of 110 mm and connecting waveguides having a rectangular cross section of 9.53 mm × 19.05 mm has a very low reflection coefficient of $\leqq 0.03$ and a large bandwidth of 32% relative to the midband frequency. The bandwidth can be increased even further by using an annular ridged waveguide. The range of the angle of rotation depends on the dimensioning of the deflecting elements 9,10 or 21,22. For example, a single-channel embodiment (FIG. 3) has a maximum angle of rotation of 270°, and a two-channel embodiment (FIG. 5) still has a maximum angle of rotation of 110°.

Figure 6:
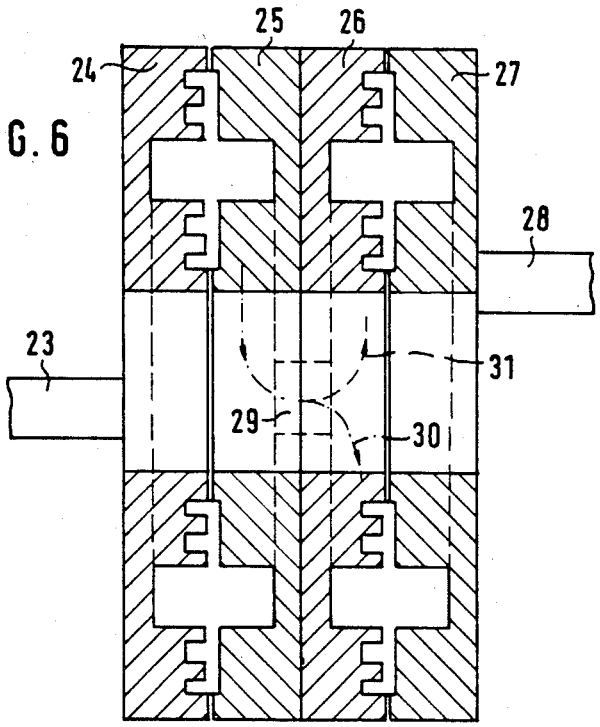
FIG. 6 is a cross-sectional view of a rotary coupling according to the invention whose electrical length can be kept constant or can be varied.

In a rotary coupling composed of two waveguide sections, the electrically effective path length in the interior of the rotary coupling changes with the angle rotation. FIG. 6 now shows a cross-sectional view through an expanded rotary coupling in which the electric path length can be kept constant.

This rotary waveguide coupling comprises a first waveguide section 24, a second waveguide section 25 connected so as to be rotatable with respect to the first waveguide section, a third waveguide section 26 fastened to the outer surface of the second section 24 for rotation therewith, and a fourth waveguide section 27 which is connected so that it is rotatable with respect to the third waveguide section 26. In the single-channel embodiment shown in FIG. 6, the first waveguide section 24 is provided with a waveguide input 23 and the fourth waveguide section 27 is provided with a waveguide output 28. Additionally, the input and output of the waveguide sections 25 and 26 are aligned to provide a passage or coupling opening 29 in the partition between the second and third waveguide sections 25 and 26. Deflecting elements (not shown in the drawing for the sake of clarity) are disposed to both sides of the passage opening 29 to conduct the wave from waveguie section 25 over to waveguide section 26 without a change in the direction of rotation. The dot-dash line 30 in FIG. 6 indicates the wave guidance through the opening 29. With a certain relative movement of the two permanently connected center waveguide sections 25 and 26 with respect to the outer waveguide sections 24 and 27 which rotate with respect to one another, the electrical path length in the rotary coupling remains constant because of an extension of the path, due to rotation of, for example, the first waveguide section 24 with respect to the second waveguide section 25, is compensated by a shortening of the path due to rotation of the fourth waveguide section 27 with respect to the third waveguide section 26. In this arrangement, preferably the outer waveguide sections 24 and 27 are maintained stationary and the fixedly coupled inner waveguide sections 25 and 26 are rotated relative to same.

With a slight modification of the rotary coupling of FIG. 6 described above, it is also possible to realize a waveguide with variable length, as it is frequently demanded for measuring purposes or for a phase shifter. In that case, the deflecting elements at the passage opening 29 are oriented such that the wave coming out of waveguide section 25 and guided through opening 29 into waveguide section 26 is reversed in its direction of rotation so that it follows the dashed line 31 in the waveguide section 26. With this arrangement, it is possible, merely by rotating the two center waveguide sections 25 and 26 with respect to the two outer, fixedly mounted waveguide sections 24 and 27, to set a desired electrical path length or phase.

The single-channel rotary coupling shown in FIG. 6 can also be expanded without much expense into a multichannel system.

The above-described embodiments of the rotary coupling have a limited angle of rotation range ($<360°$), since at least two deflecting elements move in each annular waveguide composed of two waveguide sections and hence will abut one another at certain angular positions. Since it often occurs that only a limited range of rotation is required, such rotary coupling is sufficient. However, there are cases when the coupling members must be rotatable with respect to one another without limitations.

Figure 7:
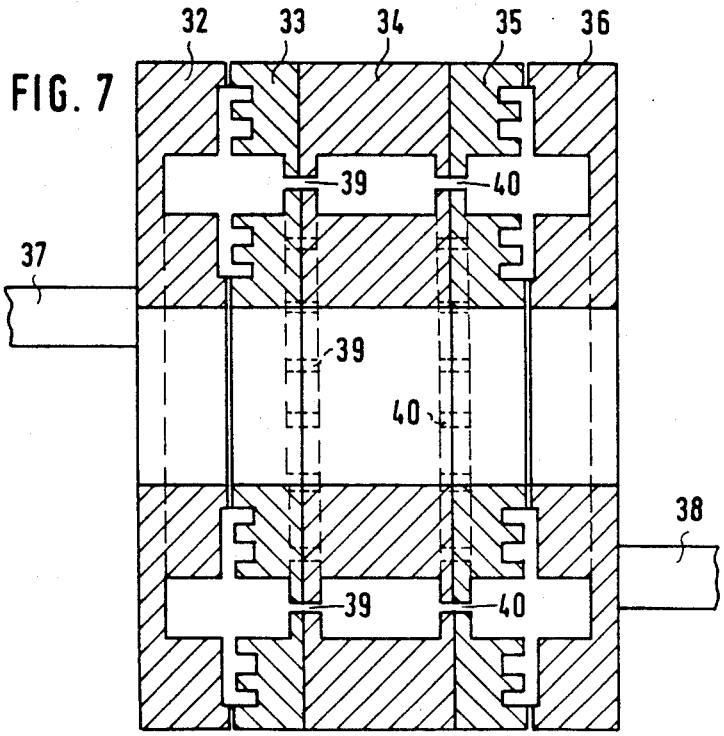
FIG. 7 is a cross-sectional view of a rotary coupling according to the invention with unlimited angle of rotation.

Such an endless rotary coupling is shown in FIG. 7. It includes a first waveguide section 32, a second waveguide section 33 connected rotatably thereto to form a rotary waveguide coupling. The rear wall of the second waveguide section 33 is fixedly connected to one side wall of an undivided, annularly bent waveguide 34 whose rear side wall is fixedly connected to a third waveguide section 35 which in turn is rotatably connected to a fourth waveguide section 36. The waveguide sections 35 and 36 again form a rotary waveguide coupling as described above. However, it is to be understood that the last two waveguide sections 35 and 36 may also be replaced by an undivided waveguide section since generally one plane of rotation, which is already provided between waveguide sections 32 and 33, is sufficient. The waveguide input 37 (and its associated deflection element) and the waveguide output 38 (and its associated deflection element) are disposed in the first waveguide section 32 and in the last waveguide section 36, respectively. The walls between the undivided waveguide 34 and the adjacent waveguide sections 33 and 35 each have a conventional 0 dB coupling structure which is indicated in FIG. 7 in the form of breakthroughs 39, 40. A 0 dB-coupler is mentioned in G. L. Matthaei, L. Young, E. M. T. Jones, Microwave Filters, Impedance-Matching Networks, and Coupling Structures, McGraw-Hill Book Comp., 1964, pp. 189, 817–820.

It is also possible to place the plane of rotation of this endless rotary coupling into the waveguide 34 which is here shown as undivided.

By providing an undivided waveguide 34, it is accomplished that no deflection elements in the mutually rotatable waveguide sections can interfere with one another so that it is possible to rotate the coupling members over any desired angular range without impediment.

In the description above of the rotary waveguide couplings, no mention has been made of the mechanical design of the rotary bearings and gears which interconnect the individual coupling elements. However, such bearings and gears are well known to persons skilled in the art.

It will be understood that the above description of the present invention is susceptible to various modifications, changes and adaptations, and the same are intended to be comprehended within the meaning and range of equivalents of the appended claims.

What is claimed is:

1. A rotary waveguide coupling comprising:

an annular waveguide divided along a separating plane to form first and second annular waveguide sections connected together so as to be mutually rotatable, said first annular waveguide section having a waveguide input port and said second annular waveguide section having a waveguide output port; and first and second deflecting means each fixedly disposed in a respective one of said first and second annular waveguide sections at a respective one of said input and output ports for imparting a defined direction of propagation to waves fed to said annular waveguide at said input port and for guiding waves out of said annular waveguide at said output port with a defined direction of propagation, each said deflecting means including a deflecting element comprising a molded part which is bent in the form of a hook to define an arcuate surface extending from the waveguide section in which that deflecting element is fixedly disposed into the other waveguide section without contacting the walls of said other waveguide section, each said molded part having a surface, separate from said arcuate surface, extending into said other waveguide section and being provided with a plurality of orthogonal grooves which define a plurality of projections between said grooves, said grooves and projections constituting a two-dimensionally oriented wave blocking structure.

2. A rotary waveguide coupling as defined in claim 1 wherein said annular waveguide has a rectangular cross section.

3. A rotary waveguide coupling as defined in claim 2 wherein said waveguide input port and said waveguide output port are disposed in the side wall of the respective said first and second waveguide sections forming the narrower side wall of said annular waveguide.

4. A rotary waveguide coupling as defined in claim 1 wherein said annular waveguide is bent in the shape of a ring in the H plane of the annular waveguide cross section.

5. A rotary waveguide coupling as defined in claim 1 wherein said annular waveguide is bent in the shape of a ring in the E plane of the annular waveguide cross section.

6. A rotary waveguide coupling as defined in claim 1 wherein the annular waveguide is free of transverse currents along the separating plane.

7. A rotary waveguide coupling as defined in claim 1, wherein each of said deflecting elements has a shape which is matched to the curvature of the waveguide.

8. A rotary coupling as defined in claim 1 wherein said second annular waveguide section has an outer side wall and said coupling further comprises third and fourth annular waveguide sections formed by dividing a further annular waveguide along a longitudinal sectional plane which is parallel to said separating plane, said third and fourth annular waveguide sections being mounted adjacent one another for relative mutual rotation about the rotational axis of said first and second waveguide sections; said third and fourth waveguide sections each presenting an outer side wall; said third waveguide section having its outer side wall fixedly connected to the outer side wall of said second waveguide section for rotation therewith; a waveguide input port in the outer side wall of said third waveguide section; a waveguide output port in the outer side wall of said fourth waveguide section; said output port of said second waveguide section being in the outer side wall of said second waveguide section and aligned with said input port of said third waveguide section to provide a coupling opening between said annular waveguide and said further annular waveguide; further deflecting means, disposed in said third and fourth waveguide section at the respective waveguide input port and at the respective waveguide output port, for imparting a defined direction of propagation of the wave fed into said further annular waveguide via said coupling opening and for bringing waves out of said further annular waveguide in a defined direction of propagation.

9. A rotary waveguide coupling as defined in claim 8 wherein: said first and fourth waveguide sections are mounted to be stationary and said fixedly connected second and third waveguide sections are mounted for rotation; and said deflecting means at said input port of said third waveguide section is oriented to reverse the direction of propagation of waves in said further annular waveguide relative to the direction of propagation of waves in said annular waveguide, whereby rotation of said second and third waveguide sections relative to said first and fourth waveguide sections results in a rotary waveguide coupling having a variable electrical length.

10. A rotary waveguide coupling as defined in claim 8 wherein: said first and fourth waveguide sections are mounted to be stationary and said fixedly connected second and third waveguide sections are mounted for rotation; and said deflecting means at said input port of said third waveguide section is oriented to maintain the same direction of propagation of waves in said further annular waveguide as in said annular waveguide, whereby rotation of said second and third waveguide sections relative to said first and fourth waveguide sections results in a rotary waveguide coupling with a constant electrical length.

11. A rotary waveguide coupling as defined in claim 1 wherein said first and second waveguide sections are axially disposed one behind the other along the axis of rotation of said coupling.

12. A rotary waveguide coupling as defined in claim 1 wherein said first and second waveguide sections are radially disposed one behind the other from the axis of rotation of said coupling.

13. A rotary waveguide coupling as defined in claim 1, wherein said first and second annular waveguide sections are connected together without being in electrical contact with one another and are constructed to define an annular gap in the region of the separating plane and a further two-dimensionally oriented wave blocking structure which is disposed in the gap, said further wave blocking structure suppressing interference waves which are excited in the separating gap and which propagate radially and tangentially within the gap.

14. A rotary waveguide coupling as defined in claim 13, wherein said annular waveguide has a waveguide cavity with a curved waveguide axis, at least one of said waveguide sections has a surface which faces the separating plane and said further wave blocking structure includes a plurality of grooves located on both sides of the waveguide cavity, some of said grooves being perpendicular to, and some of said grooves being parallel to, the curved waveguide axis so as to define a plurality of projections between said grooves.

15. A rotary waveguide coupling as defined in claim 1, wherein said first waveguide section is provided with first and second waveguide input ports, said second waveguide section is provided with first and second waveguide output ports, said first input port is associated with said first output port, said second input port is associated with said second output port, said first deflecting means includes two of said deflecting elements each disposed at a respective one of said input ports, said second deflecting means includes two of said deflecting elements each disposed at a respective one of said output ports, and the deflecting elements of associated input and output ports are oriented in opposite directions.

16. A rotary waveguide coupling as defined in claim 1, wherein each said deflecting element has a lower region which contacts the wall of the waveguide section in which that deflecting element is fixedly disposed.

17. A rotary waveguide coupling comprising:

an annular waveguide divided along a separating plane to form first and second annular waveguide sections connected together so as to be mutually rotatable, said first annular waveguide section having a waveguide input port and said second annular waveguide section having an outer side wall;

a second undivided annular waveguide axially arranged with said first and second annular waveguide sections and having first and second opposing outer side walls, the first outer side wall of said second annular waveguide being fixedly connected to the outer side wall of said second annular waveguide section for rotation therewith;

a third annular waveguide axially arranged with said second annular waveguide and having first and second opposing outer side walls, the first outer side wall of said third annular waveguide being fixedly connected to the second outer side wall of said second annular waveguide for rotation therewith and the second outer side wall of said third annular waveguide being provided with a waveguide output port;

two 0 dB coupling structure means each disposed in a respective one of the connected outer side walls of said second annular waveguide and said second annular waveguide section and of the connected outer side walls of said second annular waveguide and said third annular waveguide, for coupling wave energy from said annular waveguide into said second annular waveguide and from said second annular waveguide into said third annular waveguide;

first and second deflecting means fixedly disposed, respectively, in said first annular waveguide section at said input port and in said third annular waveguide at said output port for imparting a defined direction of propagation to waves fed to said annular waveguide at said input port and for guiding waves out of said third annular waveguide at said output port with a defined direction of propagation, each said deflecting means including a deflecting element comprising a molded part which is bent in the form of a hook to define an arcuate surface, the arcuate surface of the first deflecting means extending from the first waveguide section in which that deflecting element is fixedly disposed into the second waveguide section without contacting the walls of said second waveguide section, the molded part of said first deflecting means having a surface, separate from the arcuate surface of that molded part, extending into said second waveguide section and being provided with a plurality of orthogonal grooves which define a plurality of projections between said grooves, said grooves and projections constituting a two-dimensionally oriented wave blocking structure.

18. A rotary waveguide coupling as defined in claim 17 wherein: said third annular waveguide is formed by third and fourth annular waveguide sections produced by division of said third annular waveguide along a longitudinal sectional plane which is parallel to said separating plane; wherein the first outer side wall of said third annular waveguide is associated with said third annular waveguide section side wall fixedly connected to said second annular waveguide; said waveguide output port for said third annular waveguide and the second outer side wall of said third annular waveguide is associated with said fourth annular waveguide section; and said fourth annular waveguide section is rotatable relative to said third annular waveguide section.

19. A rotary waveguide coupling as defined in claim 18, wherein the arcuate surface of the second deflecting means extends from the fourth waveguide section into the third waveguide section without contacting the walls of said third waveguide section, the the molded part of said second deflecting means having a surface, separate from the arcuate surface of that molded part, extending into said third waveguide section and being provided with a plurality of orthogonal grooves which define a plurality of projections between the grooves, said grooves and projections constituting a two-dimensionally oriented wave blocking structure.

* * * * *